US009257746B2

(12) United States Patent
Chen et al.

(10) Patent No.: US 9,257,746 B2
(45) Date of Patent: Feb. 9, 2016

(54) PHASED-ARRAY TRANSCEIVER FOR MILLIMETER-WAVE FREQUENCIES

(71) Applicants: INTERNATIONAL BUSINESS MACHINES CORPORATION, Armonk, NY (US); MediaTek, Inc., Hsin-Chu (TW)

(72) Inventors: Ping-Yu Chen, Hsinchu (TW); Brian A. Floyd, Raleigh, NC (US); Jie-Wei Lai, Taipei (TW); Arun S. Natarajan, White Plains, NY (US); Sean T. Nicolson, Mountain View, CA (US); Scott K. Reynolds, Amawalk, NY (US); Ming-Da Tsai, Hsinchu (TW); Alberto Valdes-Garcia, Hartsdale, NY (US); Jing-Hong C. Zhan, Hsinchu (TW)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 83 days.

(21) Appl. No.: 14/136,898

(22) Filed: Dec. 20, 2013

(65) Prior Publication Data

US 2014/0132450 A1 May 15, 2014

Related U.S. Application Data

(62) Division of application No. 12/750,242, filed on Mar. 30, 2010, now Pat. No. 8,618,983.

(60) Provisional application No. 61/242,014, filed on Sep. 14, 2009, provisional application No. 61/241,950, filed on Sep. 13, 2009.

(51) Int. Cl.
*H01Q 3/26* (2006.01)

(52) U.S. Cl.
CPC ..... *H01Q 3/2694* (2013.01); *H01Q 3/267* (2013.01)

(58) Field of Classification Search
CPC ..... H01Q 3/2605; H01Q 3/267
See application file for complete search history.

(56) References Cited

U.S. PATENT DOCUMENTS 5,412,414 A * 5/1995 Ast et al. ..... 342/174
5,463,656 A 10/1995 Polivka et al.

(Continued)

OTHER PUBLICATIONS

Agrawal, A. et al., "A Calibration Technique for Active Phased Arrays", IEEE International Symposium on Phased Array System and Technology, Oct. 2003, pp. 223-228.

(Continued)

*Primary Examiner* — Cassie Galt
(74) *Attorney, Agent, or Firm* — Tutunjian & Bitetto, P.C.; Anne V. Dougherty

(57) ABSTRACT

A phased-array receiver that may be effectively implemented on a silicon substrate. A receiver includes multiple radio frequency (RF) front-ends, each configured to receive a signal with a given delay relative to the others such that the gain of the received signal is highest in a given direction. The receiver also includes a power combination network configured to accept an RF signal from each of the RF front-ends and to pass a combined RF signal to a down-conversion element, where the power distribution network includes a combination of active and passive components. Each RF front-end includes a phase shifter configured to delay the signal in accordance with the given direction and a variable amplifier configured to adjust the gain of the signal.

13 Claims, 7 Drawing Sheets

(56) References Cited

U.S. PATENT DOCUMENTS

| | | | | |
|---|---|---|---|---|
| 5,661,582 | A | 8/1997 | Kintis et al. | |
| 6,400,318 | B1 * | 6/2002 | Kasami et al. | 342/383 |
| 6,996,418 | B2 | 2/2006 | Teo et al. | |
| 7,439,901 | B2 | 10/2008 | Needham et al. | |
| 7,453,832 | B2 | 11/2008 | Steer et al. | |
| 7,496,375 | B2 * | 2/2009 | Matsumoto | 455/522 |
| 7,535,409 | B1 | 5/2009 | Cheo et al. | |
| 7,907,032 | B2 * | 3/2011 | Yamamoto et al. | 333/116 |
| 2008/0102760 | A1 | 5/2008 | McConnell et al. | |
| 2009/0015473 | A1 * | 1/2009 | Tomita et al. | 342/367 |
| 2009/0023462 | A1 | 1/2009 | Dent | |
| 2009/0146894 | A1 | 6/2009 | Drexler et al. | |

OTHER PUBLICATIONS

Agrawal, A., et al., "Beamformer Architecture for Active Phased Array Radar Antennas" IEEE Transactions on Antennas and Propagation, vol. 47, Issue 3, Mar. 1999, pp. 432-442.

Koh, et al., "A Millimeter-Wave (40-45 ghZ) 16-Element Phased-Array Transmitter in 0.18-um SiGe BiCMOS Technology", Journal of Solid-State Circuits, May 2009, pp. 1498-1509.

Koh, et al., "A Q-Band Phased-Array Front-End With Intergrated Wilkinson Couplers for Linear Power Combining in SiGe BICMOS", IEEE BCTM, Oct. 2008, pp. 190-193.

Natarajan, et al., "60GHZ-RF-Path Phase-Shifting Two-Element Phased-Array Front-End in Silocon", 2009 Symposium on VLSI Circuits Digest of Technical Papers, Aug. 2009, pp. 250-251.

Parker, et al., "Phased Arrays-Part II: Implementations, Applications, and Future Trends", Source: IEEE Transactions on Microwave Theory and Techniques, vol. 50, No. 3, Mar. 2002, pp. 688-698.

Scheir, K., et al., "A 52GHz Phased-Array Receiver Front-End in 90nm Digital CMOS" , 2008 IEEE International Solid-State Circuits Conference, Dec. 2008, pp. 184-185, 605.

Valdes-Garcia, et al., "A SIGe BICMOS 16-Element-Phased-Array Transmitter for 60 GHz Communications", IEEE International Solid-State Circuits Conference, Feb. 2010, 2 Pages.

Van Thornhout, D., et al., "Realisation of Multi-Wave Length Phased Array Laser by Hybrid Coupling of Active and Passive Waveguide Chips", 1998 CLEO/Europe Conference on Lasers and Electro-Optics Europe, 1 Page.

* cited by examiner

PHASED-ARRAY TRANSCEIVER FOR MILLIMETER-WAVE FREQUENCIES

RELATED APPLICATION INFORMATION

This application claims priority to provisional application Ser. No. 61/242,014 filed on Sep. 14, 2009, incorporated herein by reference. This application is a Divisional application of co-pending U.S. patent application Ser. No. 12/750,242, filed on Mar. 30, 2010, incorporated herein by reference in its entirety.

BACKGROUND

1. Technical Field

The present invention generally relates to phased array systems and more particularly to integrated phased-array transceivers operating at millimeter-wave frequencies 2. Description of the Related Art Phased array transceivers are a class of multiple antenna systems that achieve spatial selectivity through control of the time delay difference between successive antenna signal paths. A change in this delay difference modifies the direction in which the transmitted/received signals add coherently, thus "steering" the electromagnetic beam using the interference of multiple waves.

The 57- to 66-GHz band supports extremely high-rate (1-10 Gb/s) wireless digital communication. However, fixed-antenna 60-GHz systems are sensitive to obstructions in the line of sight (LOS). As such, beam-steering technologies are especially useful for communications in this range.

There are several prominent commercial applications of phased arrays at millimeter-wave frequencies. The 7 GHz Industrial, Scientific and Medical (ISM) band at 60 GHz is currently being widely investigated for indoor, multi-gigabit per second Wireless Personal Area Networks (WPANs). In such an application, the line-of-sight link between the transmitter and receiver can easily be broken due to obstacles in the path. Phased arrays can harness reflections of the walls due to their beam-steering capability, thus allowing the link to be restored.

Phased array systems use a plurality of signal paths, each having a variable time delay. The variable time delay in each signal path in the receiver produce a propagation delay in each signal as they reach their successive antennas. In this way, with appropriate delays at each element, the combined output signal will have a larger amplitude in a desired direction than could be obtained with a single element.

SUMMARY

The present principles allow for phased-array transmitters and receivers which can perform beam steering, attain a wide signal dynamic range and power consumption efficiency by using a combination of active and passive phase-shifting and power-combining elements. The present principles may be advantageously embodied using an integrated chip design. Such chips, often due to their small size, suffer from manufacturing variations and environmental sensitivities. The present principles are further directed to techniques for addressing the design issues that arise in such embodiments.

To this end, several exemplary embodiments are provided according to the present principles. One such embodiment is a phased-array receiver having beam-steering ability that includes a plurality of radio frequency (RF) front-ends, each configured to receive a signal with a given delay relative to the others such that the gain of the received signal is highest in a given direction. The front-ends each include a phase shifter configured to delay the signal in accordance with the given direction and a variable amplifier configured to adjust the gain of the signal. The receiver also includes a power combination network configured to accept an RF signal from each of the RF front-ends and to pass a combined RF signal a down-conversion element, wherein the power distribution network includes a combination of active and passive components.

A method for beam-steering in a phased-array receiver implemented on a silicon substrate includes the steps of receiving a signal at a plurality of receiver front-ends, phase shifting the signal at each front-end such the received signals interfere to produce a directed beam, combining the signals from the front-ends, measuring the total power of the combined signals, and adjusting an amplification gain of each of the front-ends based on the measured power output to compensate for deviations from an optimal power output.

These and other features and advantages will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein.

DETAILED DESCRIPTION OF PREFERRED EMBODIMENTS

Figure 1:
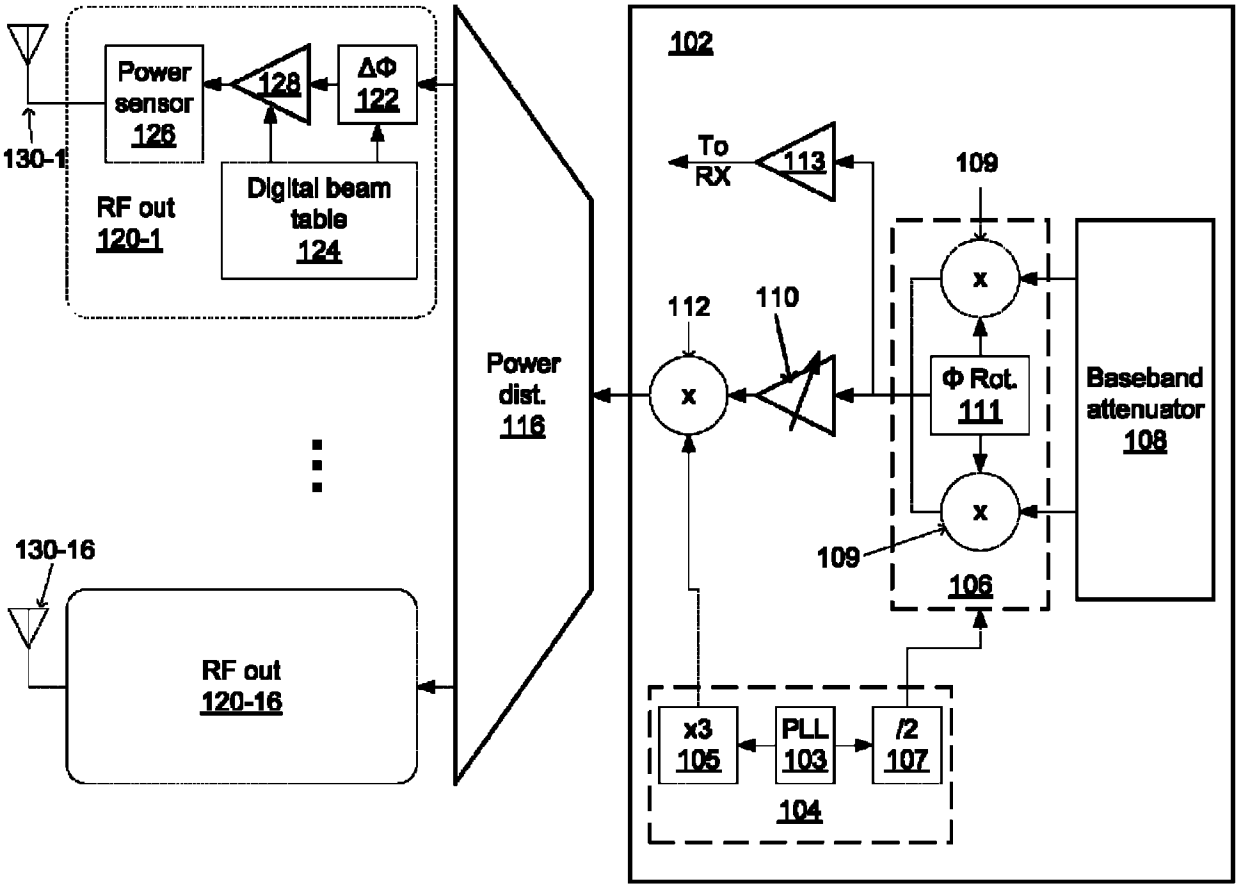
FIG. 1 is a block diagram showing a phased-array, millimeter-wave transmitter having 16 radio frequency (RF) front-ends according to one illustrative embodiment of the present principles.

The demonstration of multi-Gb/s links in the 60-GHz band has created new opportunities for wireless communications.

Due to the directional nature of millimeter-wave propagation, beam steering enables longer-range non-line-of-sight (NLOS) links at these frequencies by allowing transmitters and receivers to exploit reflections and indirect signal paths. A phased-array architecture is attractive for an integrated 60 GHz transmitter since it can attain both beam steering and higher equivalent isotropically radiated power (EIRP) through spatial combining By combining a plurality of front-ends, each with a phase shifter and a variable amplifier, the direction of a beam may be finely tuned. Additionally, the system may be greatly improved through the use of power distribution/combining trees and power-monitoring circuits, designed to compensate for manufacturing and environmental variations and to permit selective enablement of front-ends. The present principles show a fully-integrated phased-array transmitter (TX) which can support multi-Gb/s NLOS IEEE 802.15.3c links.

It is contemplated that the present embodiments will be implemented as an integrated chip (IC) package. While this allows for greatly reduced size and expense, it also renders the device more sensitive to environmental and manufacturing variations. The present principles seek to address these problems by, inter alia, providing feedback and control systems.

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented or directed by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It is to be understood that the present invention will be described in terms of a given illustrative implementation using silicon-germanium bipolar metal-oxide-semiconductor or silicon complementary metal-oxide-semiconductor process technology; however, other architectures, structures, substrate materials and process features and steps may be varied within the scope of the present invention.

The circuit as described herein may be part of a design for an integrated circuit chip. The chip design may be created in a graphical computer programming language, and stored in a computer storage medium (such as a disk, tape, physical hard drive, or virtual hard drive such as in a storage access network). If the designer does not fabricate chips or the photolithographic masks used to fabricate chips, the designer may transmit the resulting design by physical means (e.g., by providing a copy of the storage medium storing the design) or electronically (e.g., through the Internet) to such entities, directly or indirectly. The stored design is then converted into the appropriate format (e.g., GDSII) for the fabrication of photolithographic masks, which typically include multiple copies of the chip design in question that are to be formed on a wafer. The photolithographic masks are utilized to define areas of the wafer (and/or the layers thereon) to be etched or otherwise processed.

The method as described herein may be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

Referring now in detail to the figures in which like numerals represent the same or similar elements and initially to FIG. 1, an array system architecture for a transmitter according to the present principles is illustratively shown. This architecture may be advantageously implemented on a silicon substrate, though other materials may be employed instead of or in addition to silicon. The up-conversion chain 102 may follow a sliding intermediate-frequency (IF) superheterodyne architecture, which includes a frequency synthesizer 104 and a multi-mode modulator 106. The frequency synthesizer 104 uses a phase-locked loop (PLL) 103 to produce a base frequency which is then multiplied by, e.g., three in multiplier 105 to produce a radio frequency (RF) signal. It should be noted that other factors for multiplication may be employed. The base frequency is also divided by, e.g., two in divider 107 to produce an IF signal. The up-conversion chain 102 further integrates a baseband attenuator 108 that is programmable in steps of, e.g., 6 dB for both in-phase (I) and quadrature (Q) branches simultaneously, and in steps of 1 dB independently in each branch for I/Q amplitude calibration. This, combined with an IF variable gain amplifier (VGA) 110 having an exemplary gain of 20 dB, permits an exemplary programmable gain range of 40 dB which can be used to adjust the level of back-off for each modulation format.

The multi-mode modulator 106 accepts the attenuated I and Q inputs from attenuator 108 and multiplies each signal by a respective phase at multipliers 109, wherein the phase rotator 111 uses frequency information provided by synthesizer 104. The amplified signal is then frequency shifted at multiplier 112 to an RF frequency. A buffer 113 is inserted after the first up-conversion to enable an IF loopback connection with an associated receiver for I/Q calibration purposes.

The up-conversion chain 102 outputs to a power distribution module 116, described in greater detail below.

The power distribution module 116 outputs to sixteen, e.g., RF front-ends 120. The present disclosure describes a phased array that has sixteen front-ends, but other embodiments may include any number of front-ends. Employing a greater number of front-ends increases the cost of the device, but permits for more precise beam steering and increased radiated output power. Beam steering may be implemented for example by adjusting a phase shifter 122 in each of the front ends 120, as shown below. The phase delays across the front ends 120 produce an interference pattern that effectively focuses the signal in a particular direction.

The RF front ends 120 each include a beam table 124, which receives control information from a digital control (see FIG. 6 below). The beam table 124 comprises a look-up table that translates control signals relating to the direction of beam steering into a phase delay for use in transmission. The beam table 124 stores appropriate phase and gain digital control settings needed for different beam directions. In this way, the phased array beam angle can be set promptly by loading the front-end settings from a given beam table row. This technique will be described in greater detail below.

Beam table 124 controls a passive phase shifter 122 and a power amplifier 128. Power amplifier 128 comprises, in one advantageous embodiment, a 3-stage power amplifier chain, having a phase-inverting, variable-gain amplifier, a pre-driver amplifier, and a final amplifier. The power amplifier 128 can perform a phase inverting function, providing an additional 180 degrees of discrete phase shift. The phase shifter 122 accepts a transmission signal from the power distributer 116 and delays the signal by a phase dictated by beam table 124. In one advantageous embodiment, the phase shifter 122 may for example be implemented as two single-ended reflection-type phase shifters (RTPSs), having an exemplary differential phase shift range of 200° with insertion loss varying from 4 dB to 8 dB. To attain >360° phase shift range, a 180° discrete phase shift is implemented in the first stage of the power amplifier 128.

The amplifier 128 outputs the phase delayed signal to an antenna 130, as well as to power sensor 126. The power sensor 126 of each front-end 120 collects power information from the front-end 120, which is used in a digital control mechanism to monitor and control the power outputs of the front-ends. Details regarding the digital control and power monitoring are discussed with regard to FIG. 6 below.

Figure 2:
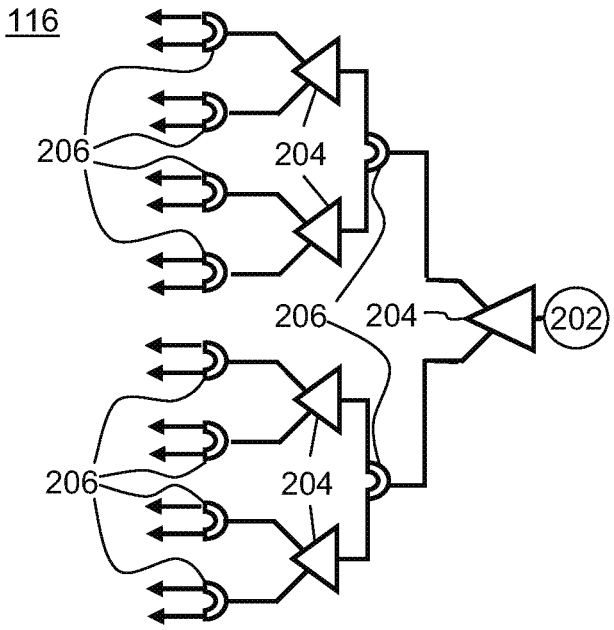
FIG. 2 is a block diagram showing a power distribution network incorporating both active and passive components according to one illustrative embodiment.

One challenge in the implementation of the phased-array transmitter is the distribution of signal power to individual elements. Referring now to FIG. 2, an exemplary embodiment of power distributer 116 is shown. The power distributer 116 comprises a set of active distribution amplifiers 204 and differential modified Gysel splitters 206 (defined in greater detail below with reference to FIG. 5). The distribution amplifiers 204 split the signal 202 while compensating for signal loss and comprise an input differential pair and two separate cascode pairs that evenly split the output current into two branches. The modified Gysel splitters 206 further divide the signal, while taking up relatively little chip area and minimizing signal routing length (and, hence, routing loss). As an example, each 1:4 power distribution unit (e.g., one distribution amplifier 204 with two modified Gysel splitters 204) may, for example, employ an area of 0.8 $mm^2$, may draw 12 mA from a 2.6V supply, and may have a single-path gain of 4 dB. Matching may be incorporated to permit different millimeter-wave circuits to operate with different characteristic impedances by making the characteristic impedance seen at the splitter input or output the complex conjugate of the circuit connected to said input or output, so as to achieve most efficient RF power transfer. The splitter can have different input and output impedances, thereby "matching" the circuits at input and output.

An additional advantage of the power distribution tree 116 shown in FIG. 2 is that it permits the selective enablement of front ends 120. By turning off amplifiers 204, the signal may be directed to a subset of the front ends 120, allowing for energy savings in situations where less transmission power is needed.

Figure 3:
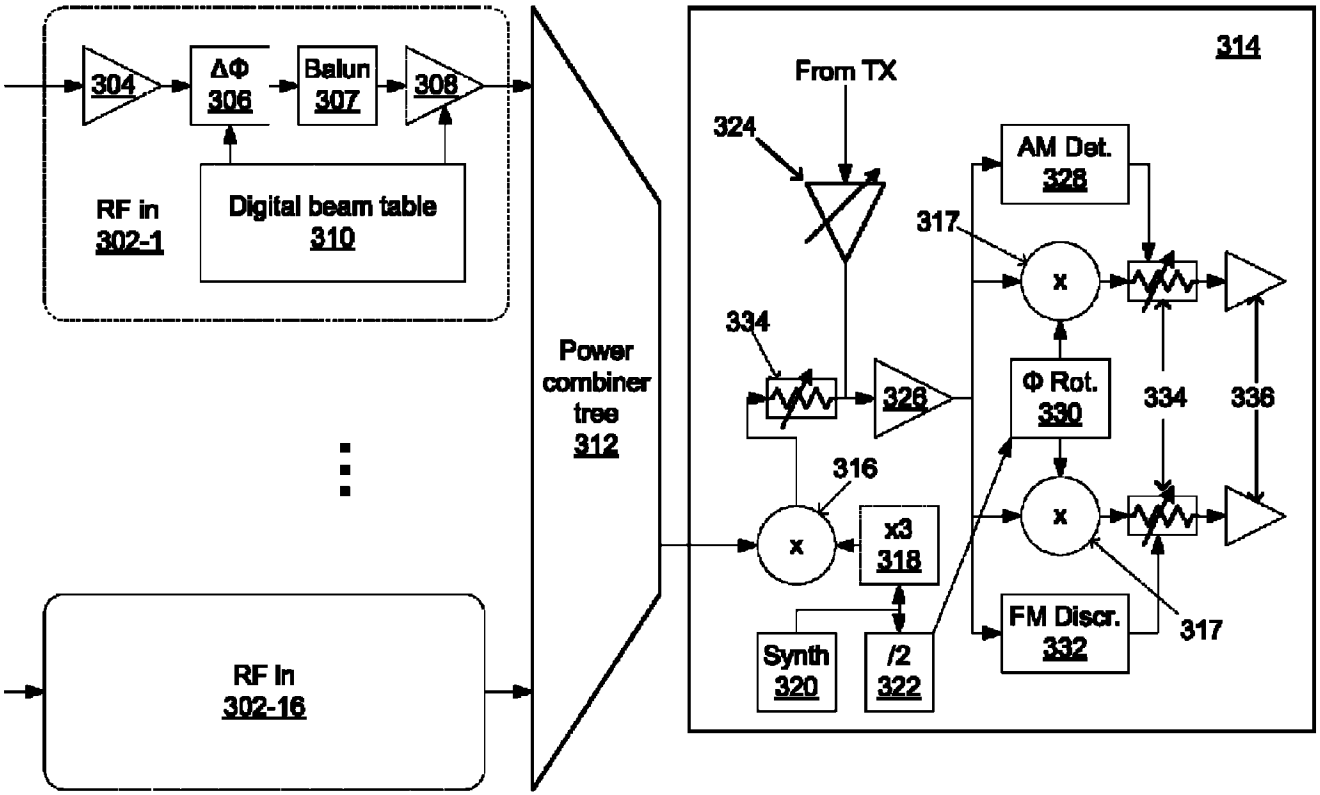
FIG. 3 is a block diagram showing a phased-array, millimeter-wave receiver having 16 RF front-ends according to the present principles according to one illustrative embodiment.

Just as transmitters benefit from the improved beam steering permitted by the present principles, so too do receivers. Referring now to FIG. 3, an exemplary phased-array receiver suitable for use in 60-GHz communications on a silicon substrate is shown which employs RF-path phase shifting followed by mostly-passive RF signal combining. Each of sixteen receiver inputs is applied to an RF front-end 302. Again, note that sixteen inputs are shown herein purely for the sake of example, where in fact greater and lesser numbers are also contemplated. The RF front-ends 302 comprise a stepped-gain, low-noise amplifier 304, a digitally-controlled phase shifter 306, a balun 307, and a phase-inverting (0/180) variable gain amplifier (PIVGA) 308. Fine phase control can achieved through an RTPS, which may include varactor-adjusted loads on a 90°-hybrid coupler. The balun 307 takes the output of the fine phase shifter and produces differential signals. An additional 180° phase shift is achieved by inverting the output phase in the differential following the passive phase shifter. The PIVGA 308 also compensates for the phase-shift dependent loss of the RTPS, ensuring constant front-end gain across phase shift settings. The front-ends 302 each output their signals to power combiner tree 312. The power combiner tree has a structure similar to the power distribution tree shown above with respect to FIG. 2. The power combiner tree 312 is described in greater depth below. The combiner tree outputs a signal to RF down-conversion mixer 316.

The power of the input to the RF down-conversion mixer 316 can be substantially higher than in the case of a single-element receiver. As such, it is advantageous to use a mixer (and subsequent circuitry) with a wide dynamic range. A local oscillator (LO) signal is provided to the mixer 316 by frequency synthesizer 320 and frequency tripler 318. The output of the first mixer 316 passes through a tunable IF filter 334 and a coarse attenuator 326 before being buffered and converted to a baseband signal by a second set of quadrature (IQ) mixers 317. Each IQ mixer 317 also receives a signal from phase rotator 330. The phase rotator 330 in turn receives a second LO signal, provided by a divide-by-2 block 322. The phase rotator 330 thereby permits IQ accuracy to be adjusted to within ±1°. An IF loopback calibration scheme with a companion transmitter permits even finer adjustment in the baseband. The IQ calibration VGA 324 accepts loopback information from the transmitter and allows path gain to be adjusted, such that calibration can be performed over baseband settings.

The receiver shown in FIG. 3 may be implemented with digital controls. The phase and gain of RF front-ends 302 may be made controllable with respect to bias points, temperature compensation coefficients, selective power-down modes, and the activation/de-activation of power detection and calibration components. Additionally, a loopback connection between a receiver and a transmitter enables measurement of quadrature phase and amplitude error using both analog and digital baseband techniques. The loopback path may be bypassed during normal operation. Phase and amplitude error may be corrected using digital control offset circuits in the transmitter IF mixer 112 and the LO-path phase rotators 111 and 330 in the transmitter and receiver respectively. The addition of AM detector 328 and FM discriminator 332 make the receiver more versatile. Although the present principles are contemplated for use with advanced digital modulation schemes, the receiver may also support amplitude shift keying, frequency shift keying, and minimum shift keying, which can be demodulated using these simple detectors. The AM detector 328 may also be used in the loopback path for IQ imbalance calibration.

Figure 4:
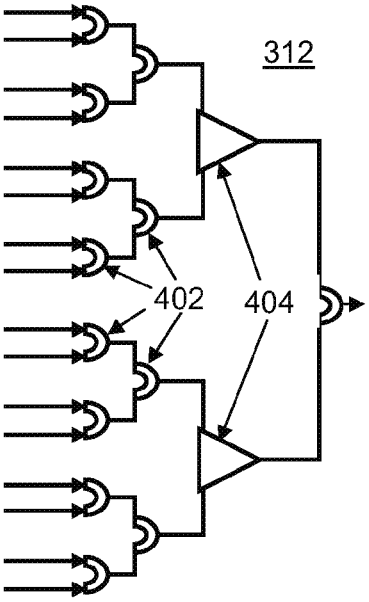
FIG. 4 is a block diagram showing a power combining network incorporating both active and passive components according to one illustrative embodiment.

Referring now to FIG. 4, an exemplary embodiment of power combiner tree 312 is illustratively shown. This embodiment of the power combiner tree 312 comprises a number of modified Gysel combiners 402 which passively combine signals, as well as active power combiners 404. Using the described modified Gysel combiners, the power combiner occupies 50% the amount of area that a Wilkinson combiner tree would need. Active combiners 404 provide gain and buffering to compensate for passive losses that arise in the modified Gysel combiners 402, and also allow for power down and isolation of groups of front-ends. In this manner, the number of active elements can be controlled and tailored according to particular needs.

Figure 5:
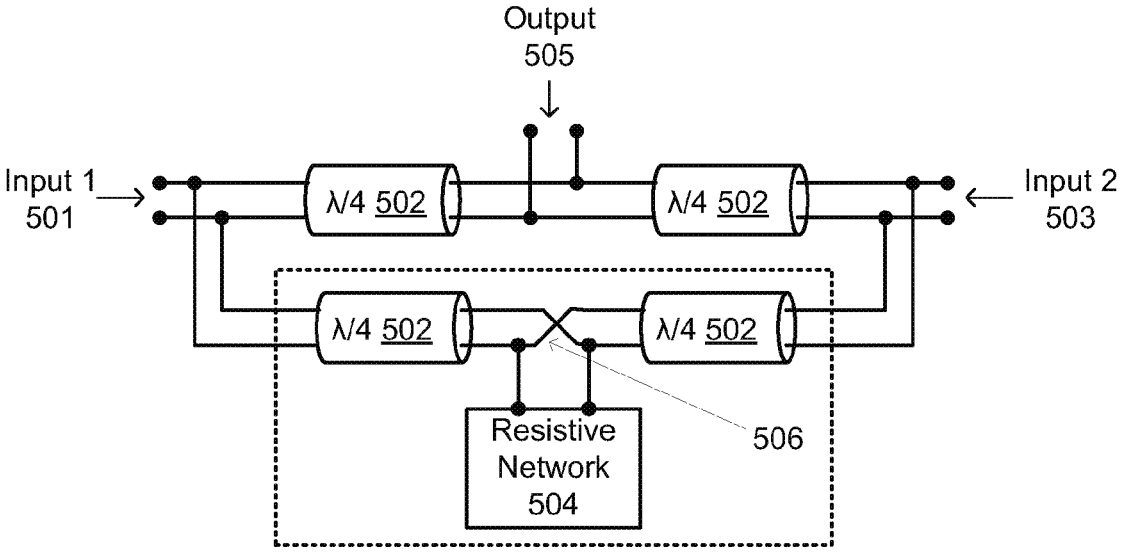
FIG. 5 is a block diagram showing a modified Gysel combiner according one illustrative embodiment.

Referring now to FIG. 5, a detailed view of a modified Gysel combiner is shown. FIG. 5 also shows the basic layout of a modified Gysel splitter, as discussed above. Being a passive element, a modified Gysel combiner may function as a modified Gysel splitter if its inputs and outputs are reversed. Inputs 1 and 2 (501 and 503 respectively) follow transmission lines 502 that represent a quarter-wavelength. The resistive network 504 decouples the inputs from one another, allowing for a cleanly combined signal at output 505. By introducing a cross-coupled transmission line 506 between the outputs as shown, the combiner achieves isolation between them, while a) not requiring the outputs to be co-located as in a differential Wilkinson divider, and b) reducing the transmission line length needed in a Gysel divider.

Figure 6:
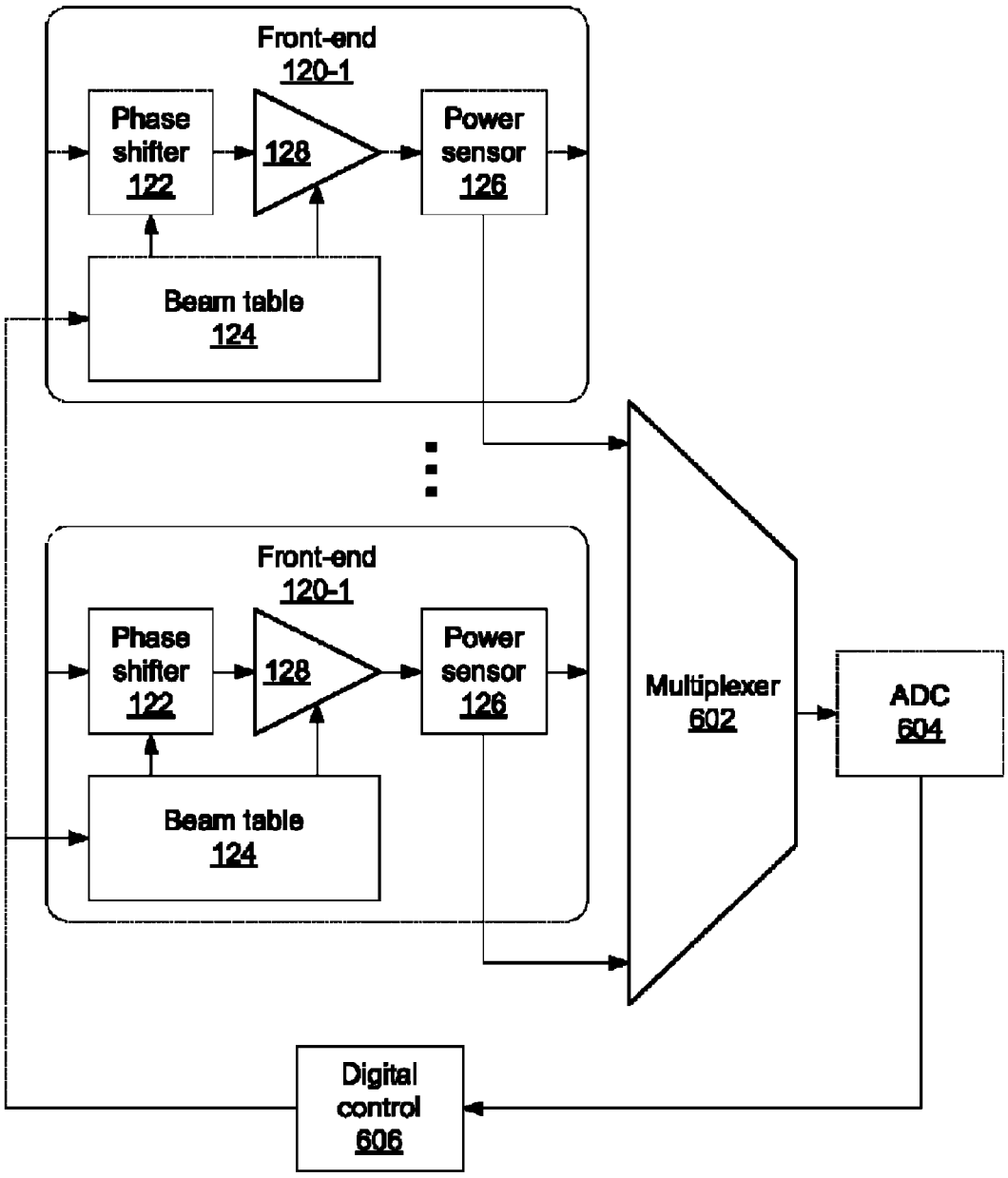
FIG. 6 is a block diagram showing a power monitoring system for a phased-array, millimeter-wave transmitter according to one illustrative embodiment.

Referring now to FIG. 6, a digital control system for a phased-array transmitter is shown. One preferred embodiment of the present principles is as an integrated circuit. Such an implementation may result in extremely small components, such that manufacturing variations may create substantial variations in performance, potentially ruining the device. In addition, on such scales temperature differences may introduce significant changes that further frustrate the desired performance. As a result, silicon implementations of the present embodiments can greatly benefit from run-time monitoring of the power output of the elements. By keeping track of the actual power inputs and outputs, it is possible to control the gains of the amplifiers discussed above to maintain desired power levels.

As noted above, front-ends 120 each include a power sensor 126. The power sensors 126 measure the output of the front end 120, before it goes to the antenna (not shown). These power measurements are collected at multiplexer 602, which can select any or all of the power inputs. An analog-to-digital converter 604 converts the power signals to digital signals and provides them to digital control 606. The digital control 606 monitors the power outputs and, based on such information as the power output and the temperature, determines the most appropriate gain and phase settings for the front-ends 120. The digital control 606 provides these settings to the front-ends' beam tables 124, which produce particular phase and gain settings to the phase shifter 122 and amplifier 128 respectively.

Figure 7:
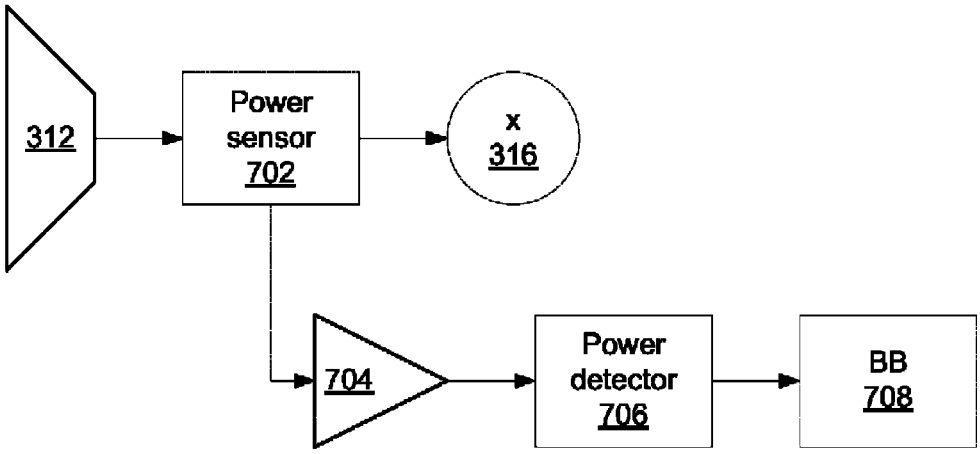
FIG. 7 is a block diagram showing a power monitoring system for a receiver according to one illustrative embodiment.

Referring now to FIG. 7, a received signal strength indicator (RSSI) is shown for an N-element phased-array receiver according to the present principles. The RSSI functions as part of an automatic gain control loop in the receiver. The RSSI includes a power sensor 702 that measures the power output by power combiner tree 312. This permits the RSSI to measure the combined power put out by all of the receiving elements in the front-ends. To achieve high sensitivity, pre-amplifier 704 is used to provide increased voltage gain and output voltage swing. Power detector 706 then takes the amplified RF signal and converts it to an output DC current. To that end, power detector 706 includes a transconductance stage and a programmable current sensor with a wide dynamic range. To adjust the input range of the current sensor, its operation bias level is dynamically adjusted according to the input signal level. The output of the power detector 706 is digitized and sent to the digital baseband IC 708. The digital baseband IC 708 "decides," based on the received power level and the output of the baseband amplifiers 336 shown in FIG. 3, how to adjust the receiver gain stages. Alternately, the receiver may include digital logic in a digital control to perform this function if the digital baseband IC 708 cannot respond quickly enough.

Figure 8:
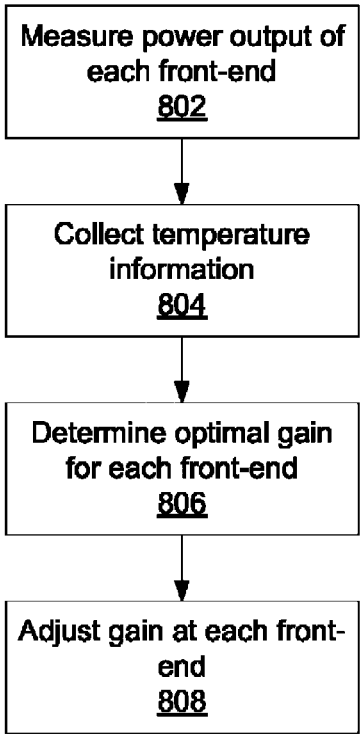
FIG. 8 is a block/flow diagram showing a method for adjusting front-end gain in a phased-array transmitter to accommodate for manufacturing and environmental variations according to one illustrative embodiment.

As noted above, silicon implementations of the present principles allow for unwanted variations in front-end gain. To accommodate these differences, it is advantageous to monitor the actual power output of the front-ends and to measure environmental characteristics. Referring now to FIG. 8, a method for accommodating for such variations is shown. The actual power output for each front-end is collected at block 802. Temperature information is further collected at 804, wherein it is possible to collect a temperature for the entire chip or to collect a temperature for each individual front-end. These data are then used by a digital control to determine an optimal gain for each front end at block 806. The front-ends are then adjusted according to said optimal gains at block 808.

Figure 9A:
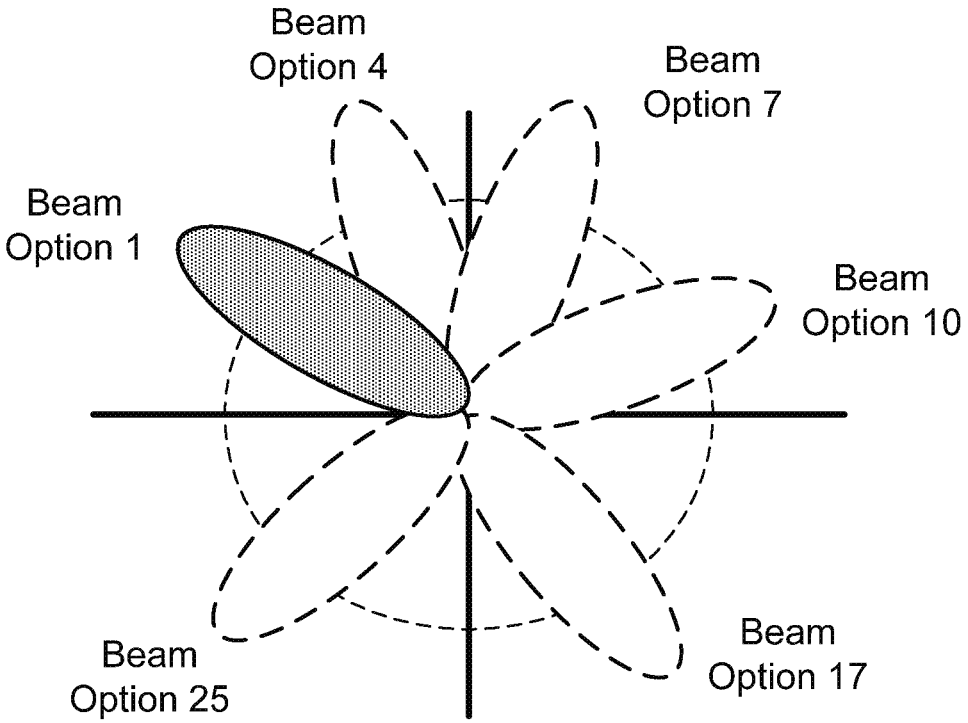
FIG. 9*a* is a graph showing an example of beam scan-range options enabled by beam tables according to the present principles, where N options for beam directions covered by the beam table span 4 quadrants.
Figure 9B:
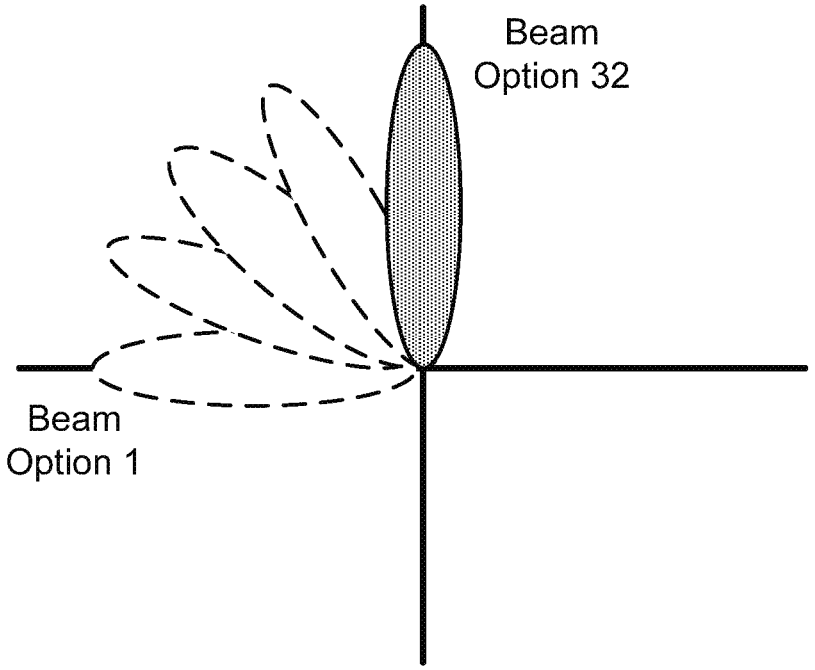
FIG. 9*b* is a graph showing an example of beam scan-range options enabled by beam tables according to the present principles, where N options for beam directions can be configured in the beam table to offer a narrow beam and finer scan range across 1 quadrant.

In applications where constant throughput needs to be maintained, fast beam steering is advantageous to find an alternate transmission path when the path in use is suddenly blocked. An example of such an environment would be an office, where narrow hallways and moving obstacles may cause sudden and unexpected changes in signal strength and direction. The use of beam tables 124 permits an immediate change in direction by simply loading corresponding, pre-programmed, settings. This operation can be performed in parallel in all elements. In addition, the contents of the beam table can be updated any time to adjust the desired set of beams directions to choose from. Referring to FIG. 9, a programmed set of directions can include relatively broad beams covering four quadrants of scan range. Alternatively, a set of finer beams in a particular quadrant can be chosen. These are just two examples of beam sets to illustrate the advantage enabled by the use of beam tables. Different beam sets can be configured for multiple purposes such as choice of side-lobe suppression, cancellation of received/transmitted power in a given direction, etc.

Having described preferred embodiments of a system and method (which are intended to be illustrative and not limiting) for phase array transceivers for millimeter-wave frequencies, it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A phased-array receiver having beam-steering ability, comprising:

a plurality of radio frequency (RF) front-ends, each configured to receive a signal with a given delay relative to the others such that the gain of the received signal is highest in a given direction, each of the plurality of RF front-ends comprising:

a phase shifter configured to delay the signal in accordance with the given direction; and a variable amplifier configured to adjust the gain of the signal; and a power combination network configured to selectively accept an RF signal from each of the RF front-ends and to pass a combined RF signal to a down-conversion element such that RF signals from unselected RF front-ends are not part of the combined RF signal, wherein the power combination network includes a combination of active and passive components that include a cross-coupled transmission line and a decoupling resistive network.

2. The receiver of claim 1, wherein the RF front-ends each further comprise a digital beam table configured to adjust the respective RF front end's phase shifter's phase delay and the respective RF front end's variable amplifier's gain.

3. The receiver of claim 1, further comprising, a received signal strength indicator configured to detect the power output of the power combination network.

4. The receiver of claim 3, further comprising a digital control configured to adjust the gain of the variable amplifiers of the front-ends based on the detected power output.

5. The receiver of claim 1, wherein each phase shifter comprises:

a passive phase shifter configured to provide a continuous 180 degree range of phase shift; and a differential phase-inverting amplifier configured to provide an additional 180 degrees of discrete phase shift and variable gain amplification.

6. The receiver of claim 1, wherein the power combination network comprises:

one or more modified Gysel combiners, configured to passively combine a plurality of signals; and one or more active power combiners, configured to combine a plurality of signals and amplify the combined signal.

7. The receiver of claim 1, further comprising a loopback variable gain amplifier, configured to receive loopback information from an associated transmitter and to calibrate in-phase/quadrature gain.

8. The receiver of claim 1, wherein the phased-array receiver is formed on an integrated circuit chip.

9. The receiver of claim 1, wherein the power combination network is configured to pass a selectively combined RF signal to the down-conversion element, such that signals from unselected RF front ends are not part of the selectively combined RF signal.

10. A method for beam-steering in a phased-array receiver implemented on a silicon substrate, comprising the steps of:

receiving a signal at a plurality of receiver front-ends;

phase shifting the signal at each front-end such the received signals interfere to produce a directed receiver gain;

combining the signals from the front-ends at a power combination network configured to selectively accept a signal from the plurality of front-ends, such that signals from unselected front-ends are not part of the combined signals;

measuring the total power of the combined signals; and adjusting an amplification gain of each of the front-ends based on the measured power output to compensate for deviations from an optimal power output.

11. The method of claim 10 further comprising the step of monitoring environmental conditions, wherein the step of adjusting further adjusts the amplification gain of the front-ends based on said environmental conditions.

12. The method of claim 10, wherein said step of phase shifting directs the receiver gain to avoid obstacles in the line of sight.

13. The method of claim 10, wherein combining the signals from the front-ends comprises selectively combining signals from the plurality of receiver front-ends, such that signals from unselected front-ends are discarded.

* * * * *